United States Patent [19]

Yamakawa et al.

[11] Patent Number: 4,624,118

[45] Date of Patent: Nov. 25, 1986

[54] WASHING MACHINES

[75] Inventors: Kiichiro Yamakawa, Moriyama; Kenji Yamamoto, Kusatsu; Takao Kuraseko; Tadashi Nukaga, both of Otsu; Koichi Yoshizaki, Kusatsu, all of Japan

[73] Assignee: Sanyo Electric Co., Ltd., Japan

[21] Appl. No.: 621,366

[22] Filed: Jun. 15, 1984

[30] Foreign Application Priority Data

Jun. 20, 1983 [JP] Japan ..... 58-111307
Jun. 24, 1983 [JP] Japan ..... 58-114717

[51] Int. Cl.[4] ..... D06F 39/08

[52] U.S. Cl. ..... 68/12 R; 68/208; 68/902

[58] Field of Search ..... 68/17 R, 12 R, 18 R, 68/208, DIG. 2

[56] References Cited

U.S. PATENT DOCUMENTS

| | | | |
|---|---|---|---|
| 2,126,365 | 8/1938 | Alexopoulos | 68/208 X |
| 2,588,774 | 3/1952 | Smith | 68/DIG. 2 |
| 2,701,582 | 2/1955 | Graham et al. | 68/208 X |
| 2,809,650 | 10/1957 | Anderson | 68/DIG. 2 |
| 3,027,908 | 4/1962 | Cochran | 68/208 X |
| 3,566,631 | 3/1971 | Willis | 68/208 |
| 3,729,013 | 4/1973 | Anderson | 68/17 R X |
| 4,195,500 | 4/1980 | Tobita et al. | 68/12 R |
| 4,224,811 | 9/1980 | Yamashita | 68/208 |

*Primary Examiner*—Harvey C. Hornsby
*Assistant Examiner*—Frankie L. Stinson
*Attorney, Agent, or Firm*—Darby & Darby

[57] ABSTRACT

A washing machine having a water store tank comprising a washing tank also serving as a water extraction tank, a water transfer means for transferring water from the washing tank to the water store tank or from the water store tank to the washing tank, and adapted to perform washing by a step of carrying out at least one cycle of operation of soaking washing products for a predetermined of time in the washing tank, thereafter, transferring water once to the water store tank and then returning water to the washing tank again by means of water transfer means, a step of transferring water to the water store tank and, thereafter, rotating the washing tank to perform water extraction in the above step and a step of soaking the washing products for a predetermined of time after the completion of the above step, followed by draining.

1 Claim, 25 Drawing Figures

FIG. 4

| washing course | |
|---|---|
| full automatic course | ← → |
| semi-automatic course | ← → |
| washing only course | ← → (reuse of soap water: ← - - - → ) |
| rinse and water extraction course | ← → |
| water extraction only course | ← → |

| step | washing | | | first rinsing | | | | | second rinsing | | | | | water extraction | | | |
|---|---|---|---|---|---|---|---|---|---|---|---|---|---|---|---|---|---|
| | liquid return | washing | | draining | liquid transfer | water extraction | water feeding | rinsing | tank cleaning | draining and water extraction | water feeding | rinsing | | tank cleaning | liquid transfer | draining and water extraction | |
| reuse turn-over switch | (water feeding) | 15 min | 10 min | | | one min 30 sec | | 2 min | | water extraction after reset, 2 min | | 3 min | 2 min | | | water extraction after reset, 3 min 30 sec | 5 min 30 sec |
| reuse: soap water | ○ | ◎ | ○ | | ○ | ○ | ○ | ○ | | ○ | ○ | ◎ | ○ | | | ○ | ◎ |
| reuse: rinsing water | ○ | ◎ | ○ | ○ | | ○ | ○ | ○ | ○ | ○ | ○ | ◎ | ○ | | ○ | ○ | ◎ |
| reuse: no reuse | ○ | ◎ | ○ | ○ | | ○ | ○ | ○ | | ○ | ○ | ◎ | ○ | ○ | | ○ | ◎ |
| (water store tank) draining | simultaneous start { Water feed valve is opened for 1 min. Connection valve, draining valve are opened for 3 min. | | | | | | | | | | | | | | | | |

WASHING MACHINES

BACKGROUND OF THE INVENTION

1. Field of the Invention

This invention concerns an automatic washing machine and, more specifically, it relates to a washing machine having a washing tank also serving as a water extraction tank and a water store tank for storing water in the washing tank for reuse.

2. Description of the Prior Art

Conventional washing machines having a water store tank have been adapted to perform washing or rinsing of washing products by rotating an agitator in a washing tank, and transferring water in the washing tank as required into the water store tank at a time when the washing or rinsing has been completed and storing water therein for reuse (for instance, refer to Japanese Published Unexamined Utility Model Application No. 112789/1982 and Unexamined Patent Application No. 131485/1982). Specifically, the water store tank has only been utilized for the reuse of water in the washing tank.

Furthermore, since washing has been carried out merely by rotating the agitator in the washing tank, it is impossible to wash those fabrics tending to result in the degradation in so-called feelings such as sweater or blankets that are liable to cause creasing, pilling, shrinking and elongation due to the friction between the fabrics and the agitator and between fabrics to each other.

SUMMARY OF THE INVENTION

This invention provides a washing machine having a water store tank comprising a washing machine main body, an outer tank disposed to the main body, a washing tank rotatably supported to the inside of the outer tank and also serving as a water extraction tank, water feed means to the washing tank, a top cover for the washing tank, an agitator rotatably disposed to the inside of the washing tank, rotational means for the washing tank, rotational means for the agitator, a water store tank disposed to the washing machine main body, a forward and backward water transfer means for transferring laundry water between the water store tank and washing tank to each other, a water draining means for draining laundry water in the washing tank and control means for automatically actuating each of the above-mentioned means, wherein the control means is adapted to instruct, to each of the means, a first step of charging washing products into laundry water in the washing tank then keeping the products in laundry water for a predetermined period of time while optionally rotating the agitator by the actuation of the rotational means for the agitator during the period, a second step of transferring water in the washing tank by the actuation of the forward water transfer means from the washing tank to the water store tank and storing the same in the latter, a third step of transferring laundry water stored in the water store tank by the actuation of the backward water transfer means from the water store tank to the washing tank, a fourth step for extracting water from the washing products by the actuation of the rotational means for the washing tank during the second step and the third step at least in one cycle while the first through third steps are repeated in this order by more than one cycle, and a fifth step of draining laundry water by the actuation of the draining means.

Thus in accordance with this invention, those washing products tending to suffer degradation in so-called feelings such as sweaters or blankets e.g., creasing, pilling, shrinking or elongation can be washed satisfactorily by reducing the friction between fabrics and the agitator or between fabrics to each other, by repeating the first through third steps for more than one cycle and interposing the fourth step between the second step and the third step during operation of the above mentioned cycle.

BRIEF DESCRIPTION OF THE DRAWINGS

FIG. 4 is a step chart, FIGS. 5(*a*) through FIG. 13(*b*) are flow charts showing the flow of the operation, in which FIG. 5(*a*), (*b*) and FIG. 6(*a*)–(*c*) show the outlined flow and FIG. 7(*a*) through FIG. 13(*b*) show respective flows in details, FIG. 14(*a*), (*b*) show another embodiment corresponding to that in FIG. 13(*a*), (*b*).

DESCRIPTION OF THE PREFERRED EMBODIMENTS

Figure 1:
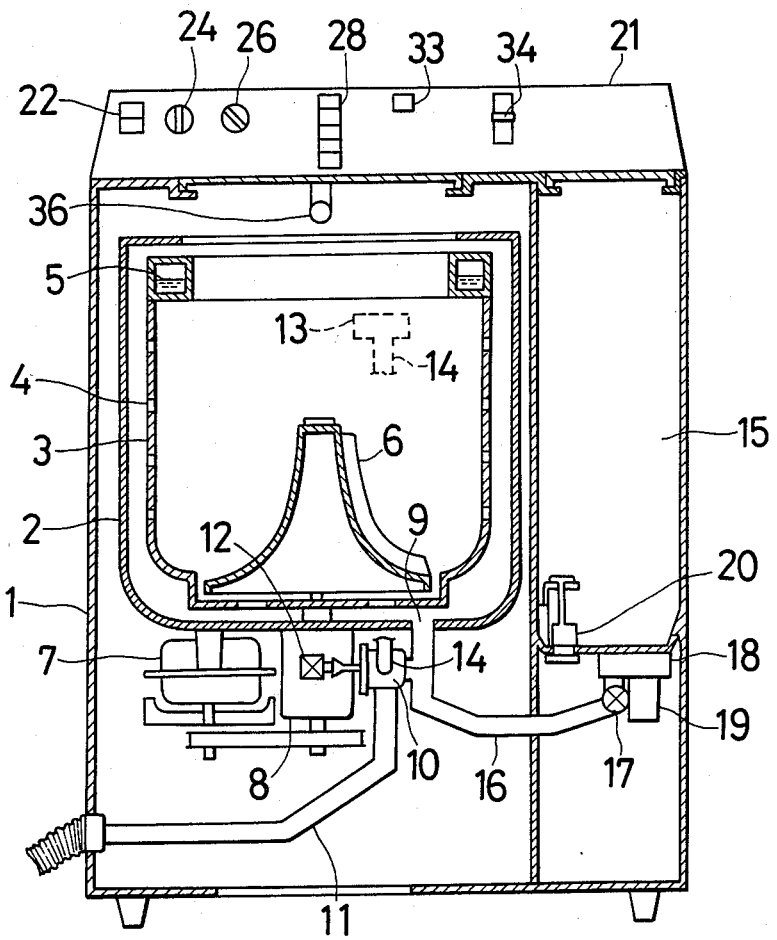
FIG. 1 is a front elevational view, in vertical cross section, for the entire part of one embodiment of a washing machine according to this invention.

FIG. 1 shows a main part for the structure of a washing machine having a water store tank according to this invention, wherein an outer tank 2 is suspended in a vibration-proof manner to the inside of a frame 1 and a washing tank 3 also serving as a water extraction tank is disposed to the inside of the outer tank 2. The circumferential wall for the washing tank 3 is formed with a plurality of water extraction holes 4. Reference numeral 5 denotes a balance ring. An agitator 6 is a disposed to the center at the bottom of the washing tank 3. A drive motor 7 for rotating the agitator 6 and the washing tank 3 and a shaft bearing case 8 are mounted at the back of the outer tank 2. A water drain port 9 for the washing tank 3 is disposed to the bottom of the outer tank and the water draining port 9 is connected by way of a draining valve 10 to a draining channel 11. A solenoid 12 for the operation of the draining valve is adapted to be excited for opening the valve. The solenoid 12 also actuates a clutch device and a brake device not illustrated and, when it is excited, it connects the clutch device to transmit the rotation of the drive motor 7 to the washing tank 3 as well as to the agitator 6 and releases the brake device for the washing tank 3. An overflow port 13 is in communication with the draining channel 11 by way of an overflow hose 14.

A water store tank 15 is mounted on the side of the frame 1, and the bottom of the water store tank 15 is connected to the water draining port 9 by means of a connection channel 16. The connection channel 16 has a reversible pump 18 and a connection valve 17 to open and close the connection channel. The reversible pump 18 is driven by a pump motor 19. The pump 18 is mounted at the bottom of the water store tank 15. The connection channel 16 is in communication by way of the draining valve 10 to the draining channel 11.

When the connection valve 17 and the draining valve 10 are opened simultaneously, the water in the water store tank 15 is drained by way of the connection channel 16, the draining valve 10 and the draining channel 11. When the connection valve is open and the draining valve is closed, the washing tank 3 and the water store tank 15 are communicated by way of the connection channel 16 and, by rotating the pump 18 forwardly, water in the washing tank 3 moves to the water store tank 15 (hereinafter referred to as liquid transfer) and, by rotating the pump 18 backwardly, the water in the water store tank 15 moves to the washing tank 3 (hereinafter referred to as liquid return). Reference numeral 20 represents a float switch for detecting the absence or presence of water in the water store tank 15. When water is absent in the water store tank 15 the float switch 20 is closed, while when water is present in the water store tank 15 the float switch is opened.

Figure 2:
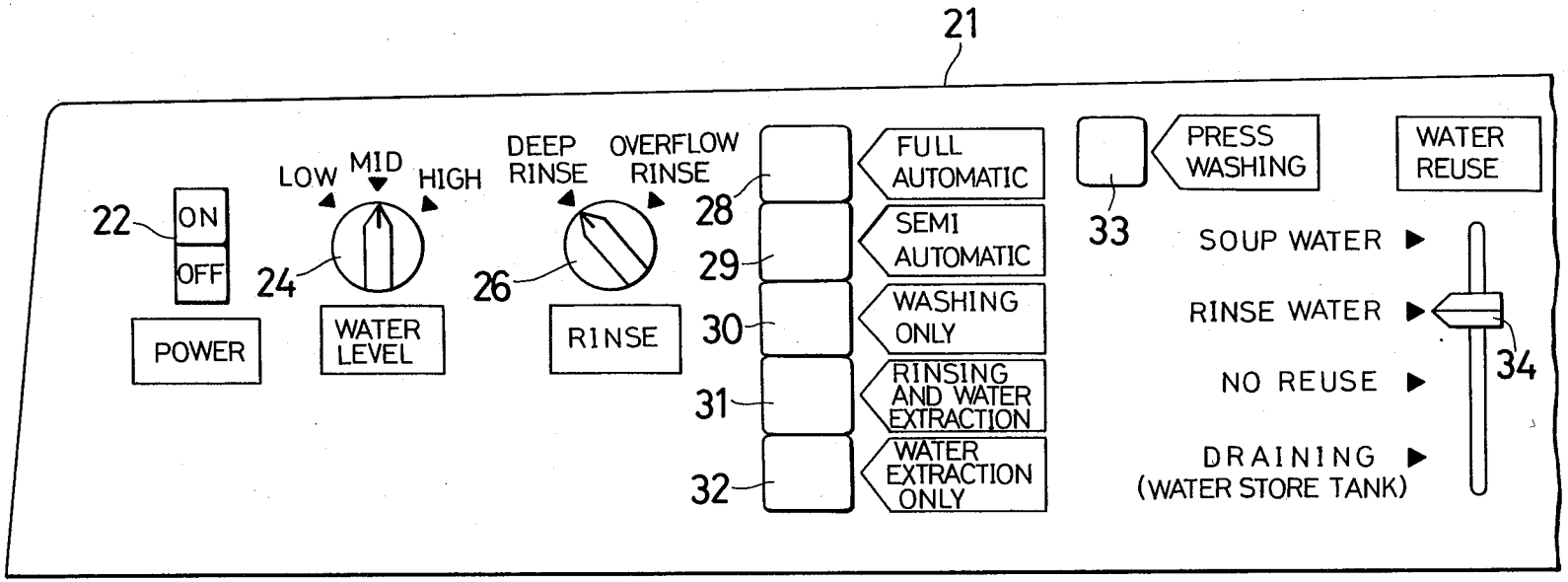
FIG. 2 is a front elevational view for the front panel of a control box thereof.
Figure 3:
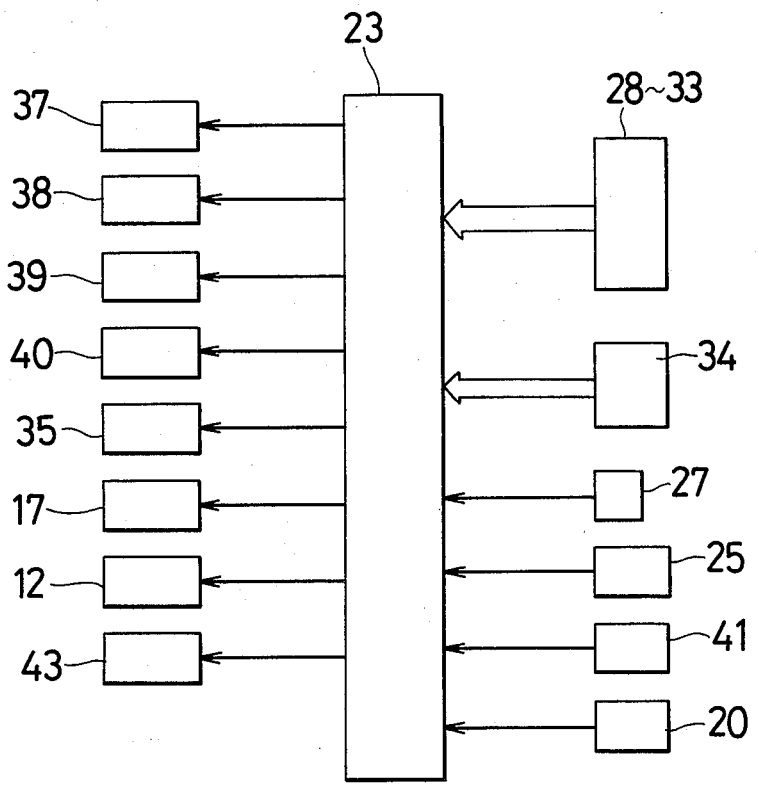
FIG. 3 is a block diagram for the control circuit.

21 denotes a control box, and various operation buttons are disposed on the front panel thereof as shown in FIG. 2. 22 denotes a power source switch and, by throwing the switch, a microcomputer 23 in the control circuit is started to operate. FIG. 3 shows a control block diagram showing the connection relation between the microcomputer 23 and each of input/output devices. A water level turn-over knob 24 for switching the water level in the washing tank 3 to high, medium or low level is interlocked with a water level switch 25 on the side of the washing tank 3 and the water level switch 25 is closed when a predetermined water level is attained in the washing tank. 26 denotes a rinse turn-over knob and, by turning the knob on the overflow rinse side, a rinse turn-over switch 27 is closed to select and perform the water overlfow rinsing operation. 28–33 denote start switches also serving as the course selection switches, which includes one switch corresponding to each of the full automatic course, semi-automatic course, wash-only course, rinse and water extraction course, water extraction-only course, and press washing course. When a signal from the switches 28–33 is inputted into the microcomputer 23, the operation is started. For each of the courses other than the press washing course, the operation is carried out within the range shown in the step chart of FIG. 4. 33 denotes a start switch for the press washing course and since it is different in the selection mode than other courses, this switch is disposed while being slightly apart from other start switches 28–32.

34 denotes a reuse turn-over switch, by which reuse of soap water, reuse of rinsing water, no reuse and (water store tank) draining are turned-over.

In the reuse of soap water, the "liquid transfer" as described above is carried out after the completion of the washing step and water is stored for reuse in the water store tank 15 as can be seen in the step chart of FIG. 4. In the reuse of rinsing water, the abovementioned "liquid transfer" is carried out after the completion of the second rinsing step to store the rinsing water into the water store tank 15. In the no reuse, water in the washing tank 3 is completely drained with no transfer to the water store tank. Further, in the (water store tank) draining, the draining valve 10 and the connection valve 17 are opened and the water feed valve 35 to the washing tank 3 is also opened. In the step chart of FIG. 4, symbol "○" means the practice of the relevant step and the symbol "◎" means the practice only for the careful course, in which a longer time is set for each period of the washing step, rinsing step, and water extraction step.

36 denotes a water feed port for feeding water by the opening of the water feed valve 35 to the washing tank 3. When the (water store tank) draining is selected by the reuse turn-over switch 34, an external hose is connected to the water feed port 36 to clean the inside of the water store tank 15.

37 denotes a rightward rotation drive circuit for rightwardly rotating the drive motor 7 and 38 denotes a leftward rotation drive circuit for leftwardly driving the motor 7. Upon washing and rinsing, the microcomputer 23 supplies electric power alternatively to the rightward rotation drive circuit 37 and the leftward drive circuit 38 to reversively operate the agitator 6. Upon water extraction, the computer supplies the electric power to the rightward rotation drive circuit 37 to perform water extracting operation.

39 denotes a drive circuit for forwardly rotating the pump 18, and 40 denotes a drive circuit for backwardly rotating the pump 18. 41 denotes a cover switch adapted to be opened upon opening of a top cover 42, which also serves as a vibration detection switch upon water extraction and also used for removing abnormality in the draining this embodiment. 43 denotes a buzzer.

Figure 5A:
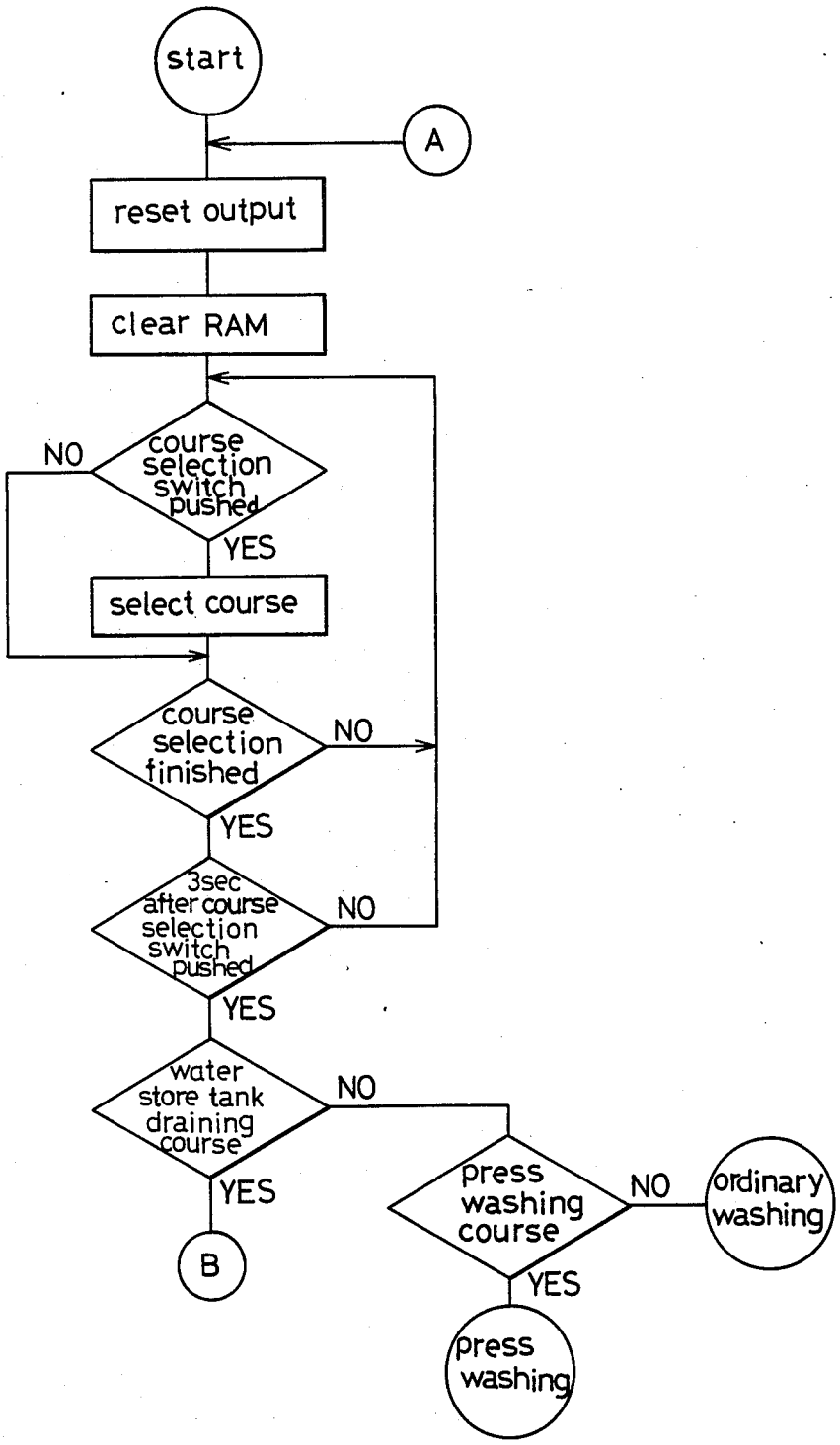
Figure 5B:
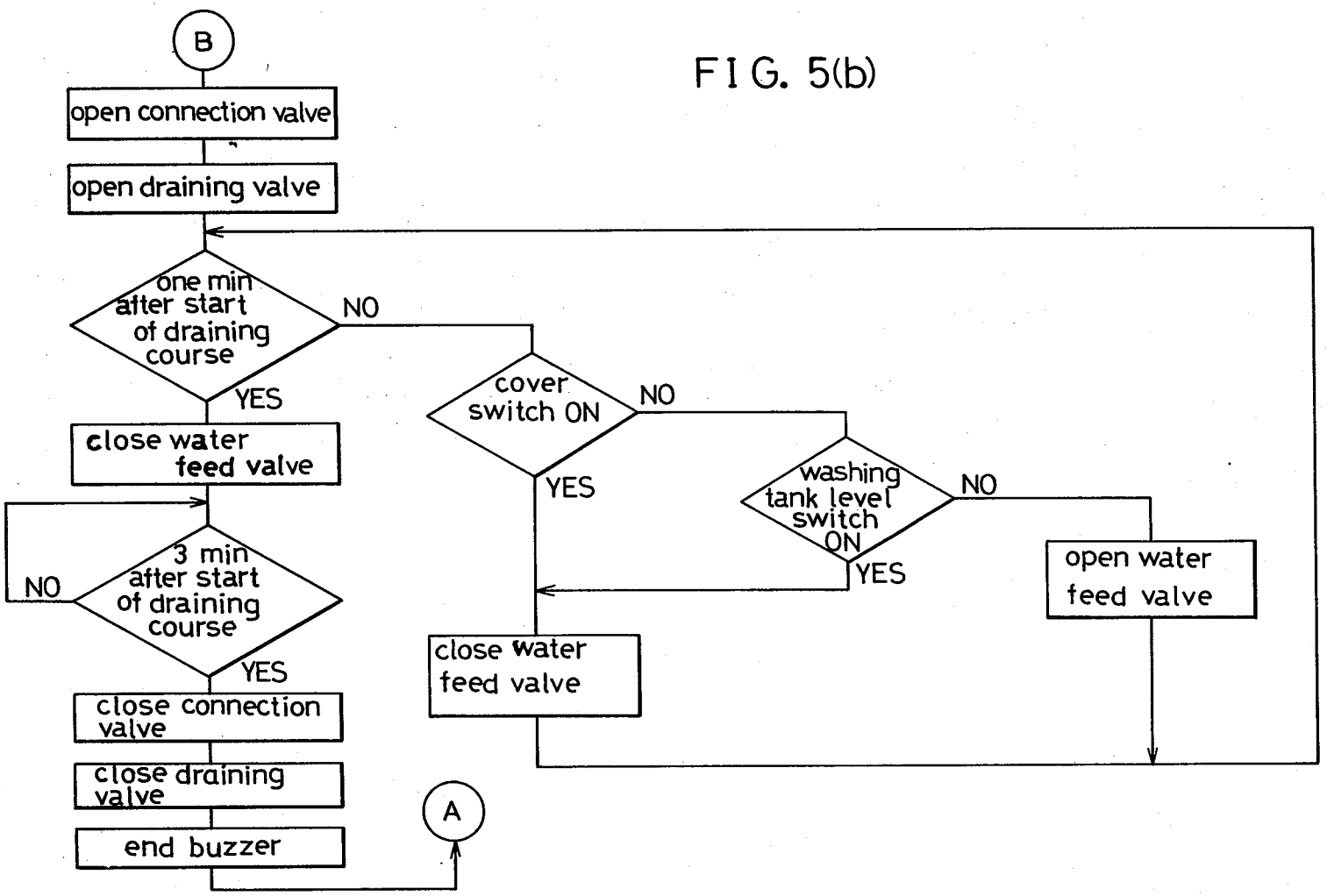

The operation of this embodiment will be explained in accordance with the flow charts shown in FIG. 5(*a*) through FIG. 14(*b*). FIG. 5(*a*),(*b*) and FIG. 6(*a*),(*b*),(*c*) are flow charts showing the outlined software for this embodiment, and complicate parts in FIG. 5(*a*),(*b*) and FIG. 6(*a*),(*b*),(*c*) are expressed in the form of sub-routines in FIG. 7(*a*) through FIG. 14(*b*). Explanation at first be made referring to FIG. 7(*a*) through FIG. 14(*b*).

Figure 7A:
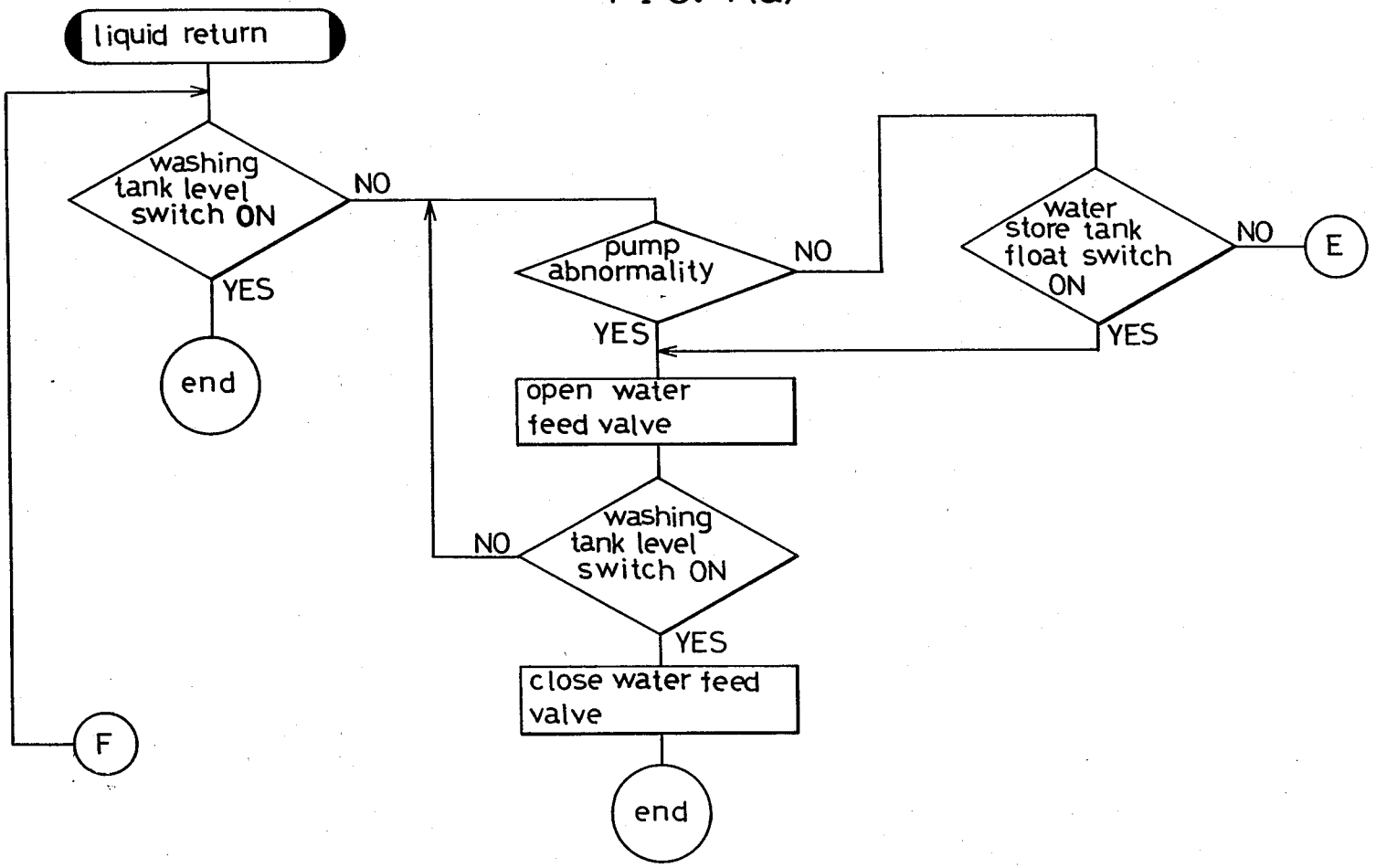
Figure 7B:
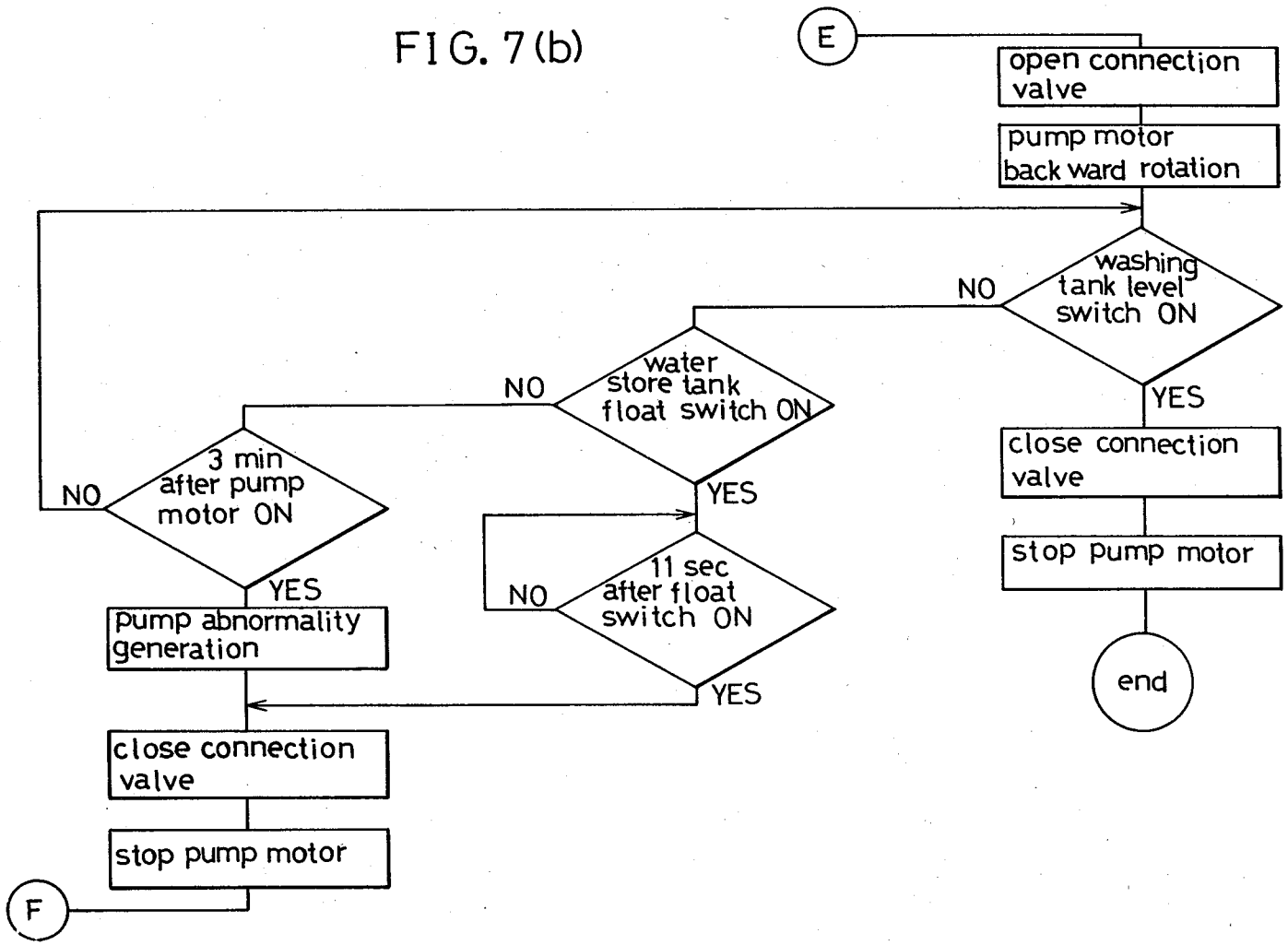

FIG. 7(*a*),(*b*) show the flow chart for the "liquid return" as described above, in which the microcomputer 23 at first judges if water is present or absent in the washing tank 3 depending on the ON-OFF state of the water level switch 25. When the water level switch 25 is closed showing the presence of water in the washing tank 3, the liquid return is not performed and the step is advanced to the subsequent processing. In the case if water is absent in the washing tank 3, the microcomputer 23 judges depending on the content in its memory if an abnormality has been generated to the pump 18. If the abnormality has been generated to the pump, the water feed valve 35 is opened till the water level switch 25 is closed to feed water into the washing tank 3.

The generation of abnormality in the pump 18 means such a state where the pump 18 no more operates normally, for example, due to the clogging of obstacles in the pump 18 and, specifically, such a state where no change occurs at least to one of the water level switch 25 as a water level detection means for the washing tank 3 or the float switch 20 as the water level detection means for the water store tank 15, even if the pump 18 has been rotated forwardly or backwardly to perform the liquid transfer or liquid return as described above over a predetermined of time, that is, 3 minutes in this embodiment. In such a case, the microcomputer judges the abnormality of the pump, memorizes the same and, thereafter, closes the connection valve 17 to stop the operation of the pump 18.

In the case if no abnormality occurs to the pump, presence or absence of water in the water store tank 15 is judged depending on the ON-OFF state of the float switch 20. In the case if there is water in the water store tank 15 (float switch 20 OFF), the connection valve 17 is opened to issue an output to the drive circuit 40 to rotate the pump 18 backwardly thereby transfer water in the water store tank 15 to the washing tank 3. In the case if there is no water in the water store tank 15 (float switch 20 ON), the water feed valve 35 is opened to feed water to the washing tank 3 till the water level switch 25 is closed.

In the case if the water level switch 25 is cosed during backward rotation of the pump 18, the connection valve 17 is immediately closed to stop the pump 18 thereby ending the liquid return. Further, if water in the water store tank 15 is eliminated during the backward rotaton of the pump and the float switch 20 is closed, the backward rotation is continued for 11 sec after that instance and then the liquid return is ended. This operation is taken, because a little amount of water still remains in the water store tank 15 even if the float switch is closed and water is also present in the connection channel 16 as well as the water store tank and, therefore, all of the water have to be returned to the washing tank 3 to avoid the loss of water as much as possible. In a case if the water level switch 25 is not closed at this instance, the water feed valve 35 is opened till the switch is closed to carry out water feeding.

In a case if the float switch 20 is not closed even when the pump 18 has been kept to rotate backwardly for 3 min, the abnormality in the pump is judged as described above, whereby the connection valve 17 is closed to stop the pump 18. Then, the microcomputer 23 memorizes the abnormality in the pump and the pump 18 is not opeated in the succeeding operation.

Figure 8A:
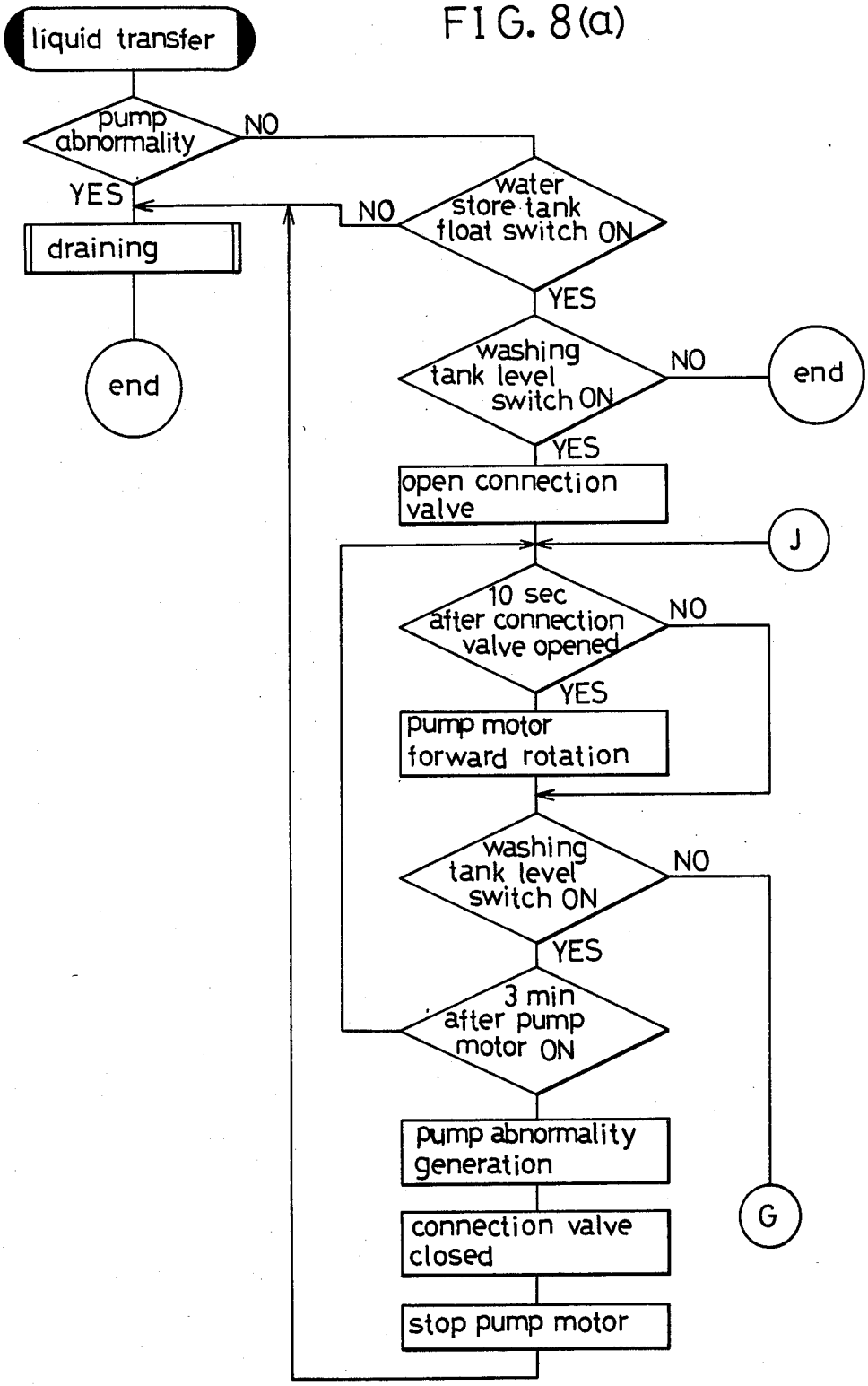
Figure 8B:
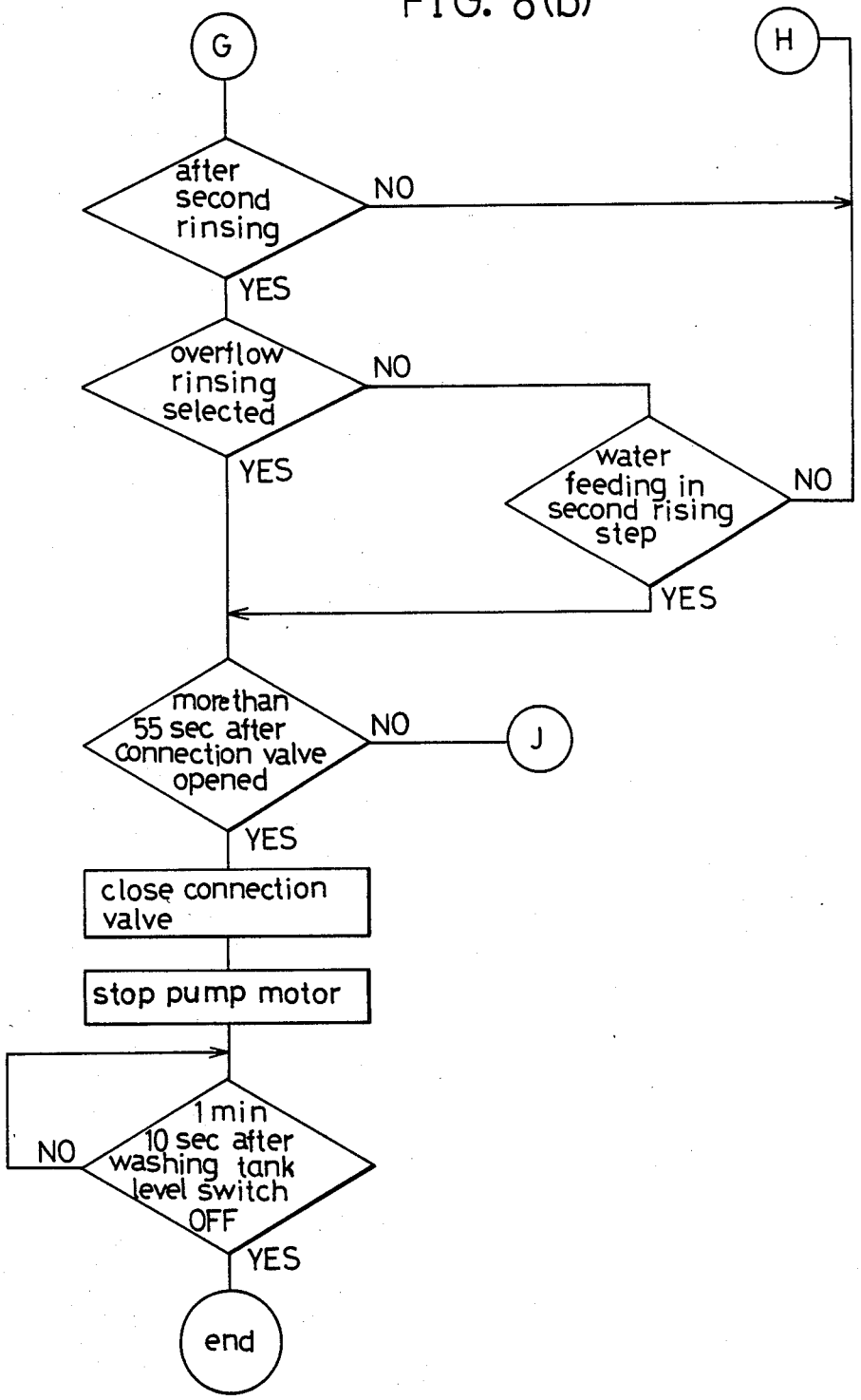
Figure 8C:
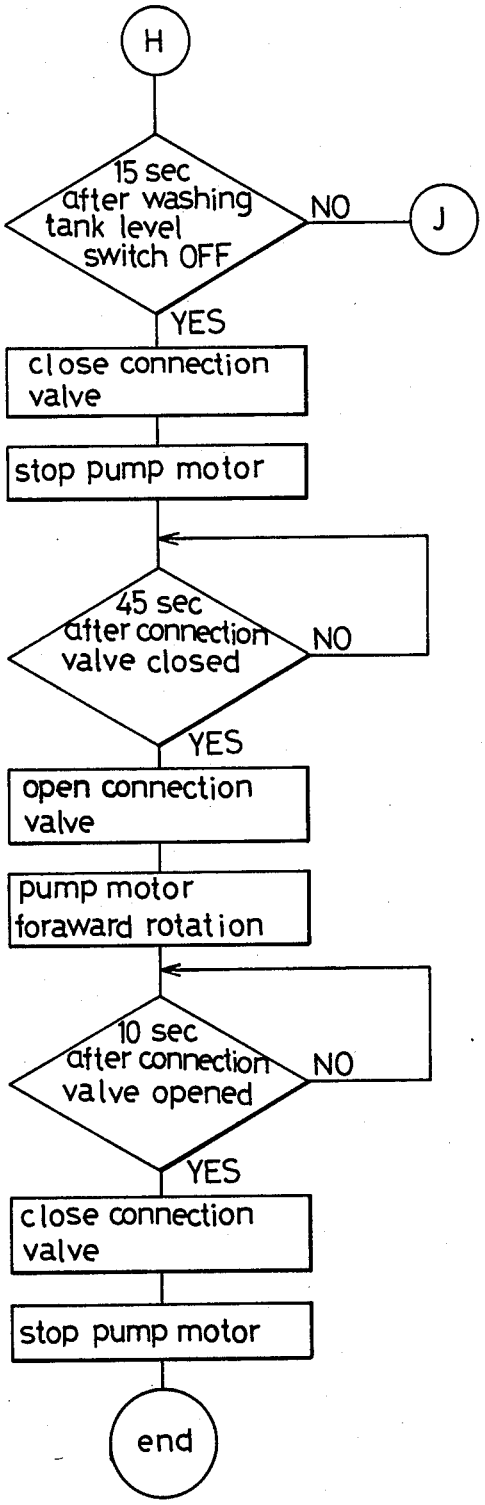

FIG. 8(*a*),(*b*),(*c*) show the flow chart for the "liquid transfer" as described above, in which the microcomputer 23 at first judges if the abnormality has been generated in the pump depending on the content stored in its memory. If the abnormality has been generated to the pump, draining shown in FIG. 10(*a*),(*b*) is conducted and the liquid transfer is not carried out. If no abnormality has been generated to the pump, the microcomputer 23 judges if water is absent or present in the water store tank 13 depending on the ON-OFF state of the float switch 20. In the case if water is present in the water store tank 15 (float switch 20 OFF), the liquid transfer is not carried out but water in the washing tank 3 is drained. This operation is taken, because if water is transferred from the washing tank 3 in the case where contaminated water is present in the store tank 15, the transferred water may be contaminated to hinder the reuse, or if water is transferred in a state where water is still present in the store tank 15, water may overflow from the upper end of the water store tank 15.

In the case where there is no water in the water store tank 15 (float switch 20 ON), absence or presence of water in the washing tank 3 is judged and, if there is no water (water level switch 25 OFF), the liquid transfer is not performed and the step is advanced to the subsequent processing. If water is present (water level switch 25 ON), the connection valve 17 is opened and an output is delivered 10 sec after to the drive circuit 39 to rotate the pump 18 forwardly thereby transfer water in the washing tank 3 to the water store tank 15. The above-mentioned 10 sec period is provided for expelling airs in the connection channel 16 and the pump 18 by water transferred from the water washing tank 3, normally operating the pump 18 upon its rotation and suppressing foaming due to airs during this period.

In the case where the water level switch 25 is not opened even after the pump 18 has been rotated forwardly for 3 min, the abnormality in the pump is judged and the microcomputer 23 memorizes the same. After the abnormality has been generated to the pump, the connection valve 17 is closed to stop the pump 18 and the draining valve 10 is opened to drain water in the washing tank 3. Hereafter, pump 18 is not operated.

In the case where the liquid transfer is carried out after the completion of the second rinsing step, that is, in the case where the rinsing water is transferred to the water store tank 15 and if the rinsing turn-over switch knob 26 is turned on the side of the overflow rinsing or in the case where the overflow rinsing during the second rinsing step has been stored in the memory (since there may be a case that the turn-over knob 26 should happen to be turned to the rinsing side after the completion of the overflow rinsing, the microcomputer is adapted to memorize the completion of the overflow rinsing), the following operation is carried out. If the water level switch 25 is opened within 55 sec after the opening of the connection valve 17, the pump 18 is rotated forwardly till the end of 55 sec while the connection valve 17 is kept open. If the water level switch 25 opens after 55 sec, the pump 18 is stopped at that instance and the connection valve 17 is closed. In either of the cases, the connection valve 17 is closed and the pump 18 is kept at the stationary state till a period of one min and 10 sec elapse after the instance that the water level switch 25 was opened.

In the usual liquid transfer other than the above, 15 sec after the opening of the water level switch 25, the connection valve 17 is once closed and the pump 18 is stopped to maintain this state for 45 sec. Thereafter, the connection valve 17 is opened for 10 sec and the pump 18 is rotated forwardly to deliver water extruded out of clothes to the water store tank 15. Since the clothes still contain water even when there is no water in the washing tank 3 (outer tank 2), water is extruded out of the clothes during this 45 sec of period and sent again to the water store tank 15 for reuse.

In a case where overflow rinsing has been carried out at the second rinsing, since there is a lot of water in the washing tank 3 and, if all of the water are transferred to the water store tank 15, they may overflow out of the tank. Therefore, the connection valve 17 is closed and the pump 18 is stopped after the elapse of 55 sec from the opening of the connection valve 17.

Figure 9A:
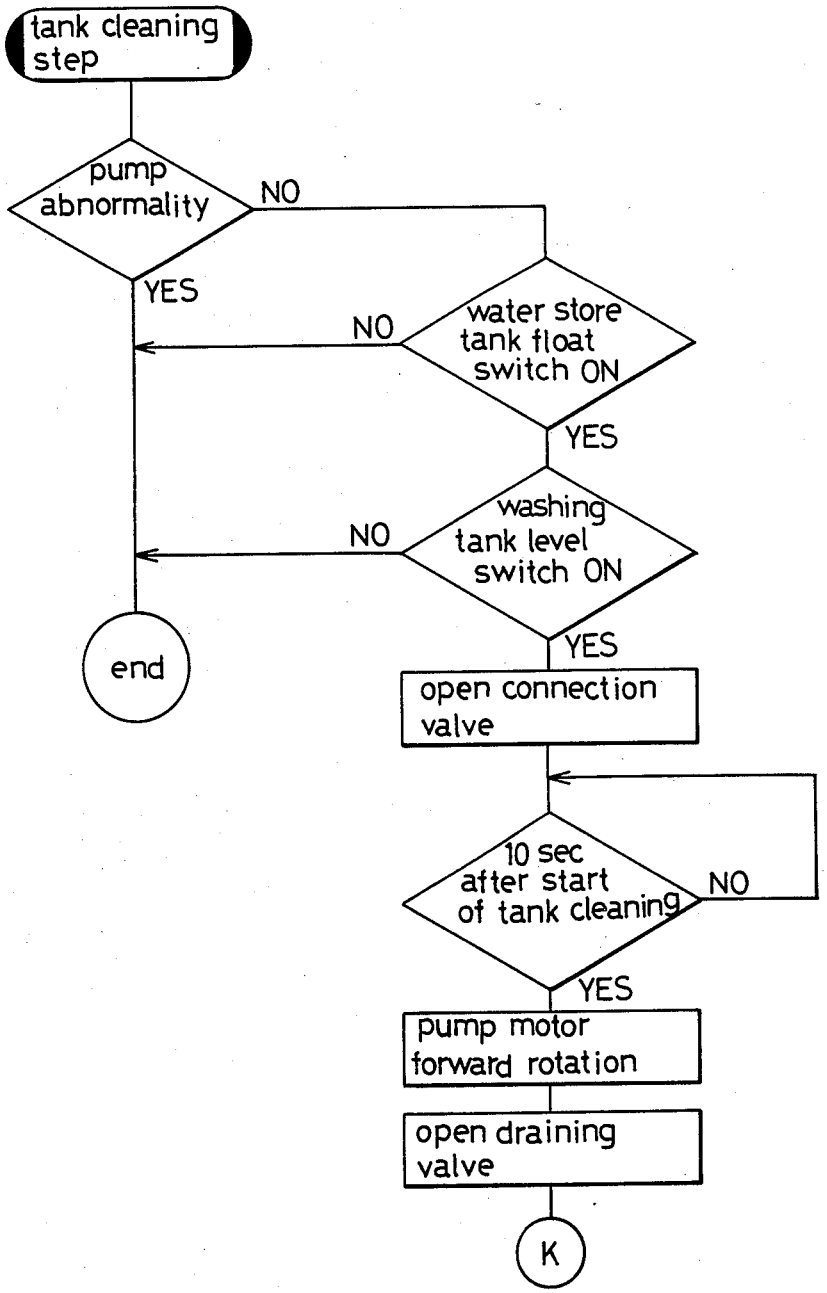
Figure 9B:
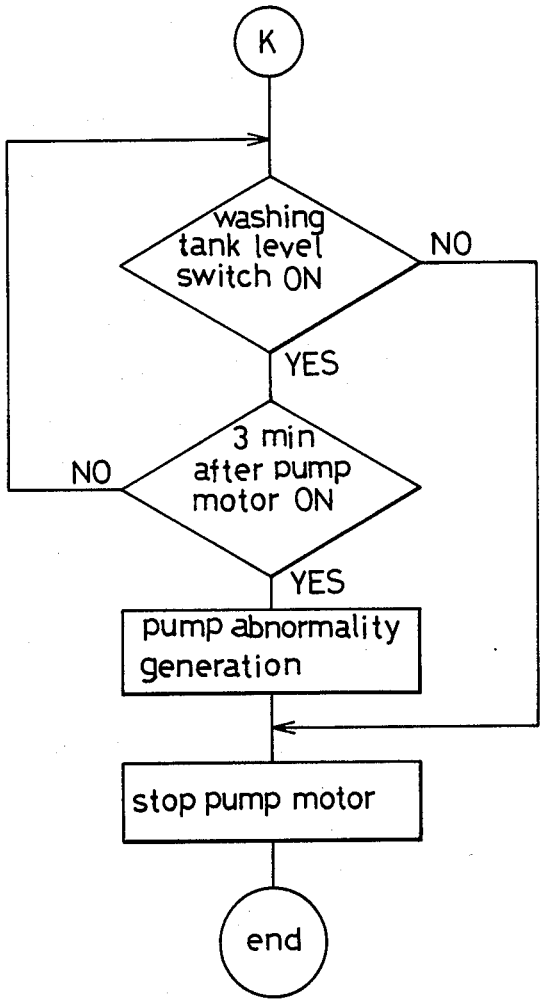

Then, the tank cleaning step for automatically cleaning the inside of the water store tank 15 will now be explained referring to the flow chart shown in FIG. 9(*a*),(*b*). Upon the tank cleaning, the microcomputer 23 at first judges whether the abnormality has been generated in the pump or not depending on the content in its memory and, if the pump abnormality has been generated, the step is advanced to the next processing without practicing the tank cleaning. If no abnormality has been generated to the pump, the connection valve 17 is opened after having confirmed the absence of water in the water store tank 15 and the presence of water in the washing tank 3 by the float switch 20 and the water level switch 25. By opening the connection valve 17, water transfers from the washing tank 3 to the water store tank 15 to expel air out of the connection channel 16 and the pump 18 as described previously, and an output is issued to the drive circuit 39 to rotate the pump 18 forwardly and to the solenoid 12 to open the drain valve 10 after 10 sec from the moment of the opening of the connection valve 17. The water transferred to the water store tank 15 is agitated by the forward rotation of the pump 18 to wash out the contaminations deposited on the wall of the water store tank. The pump 18 is driven till the water level switch 25 is opened. Since the water drain valve 10 is closed, different to the case of the liquid transfer, water in the water store tank 15 is drained by way of the connection channel 16 and the draining valve 10 after the pump 18 has been stopped. The insides of the water store tank 15 (particularly the lower portion), the connection channel 16 and the pump 18 can automatically be cleaned by this operation.

In the case if the water level switch 25 does not open even after the forward rotation of the pump 18 has been continued for 3 min, the microcomputer 23 judges the abnormality in the pump to stop the operation of the pump 18. Since the connection valve is kept open as described later in the draining step and the water extraction step after the tank cleaning, water containing the contaminations in the water store tank 13 dissolved therein is drained during draining and water extraction and does not remain in the water store tank.

Figure 10A:
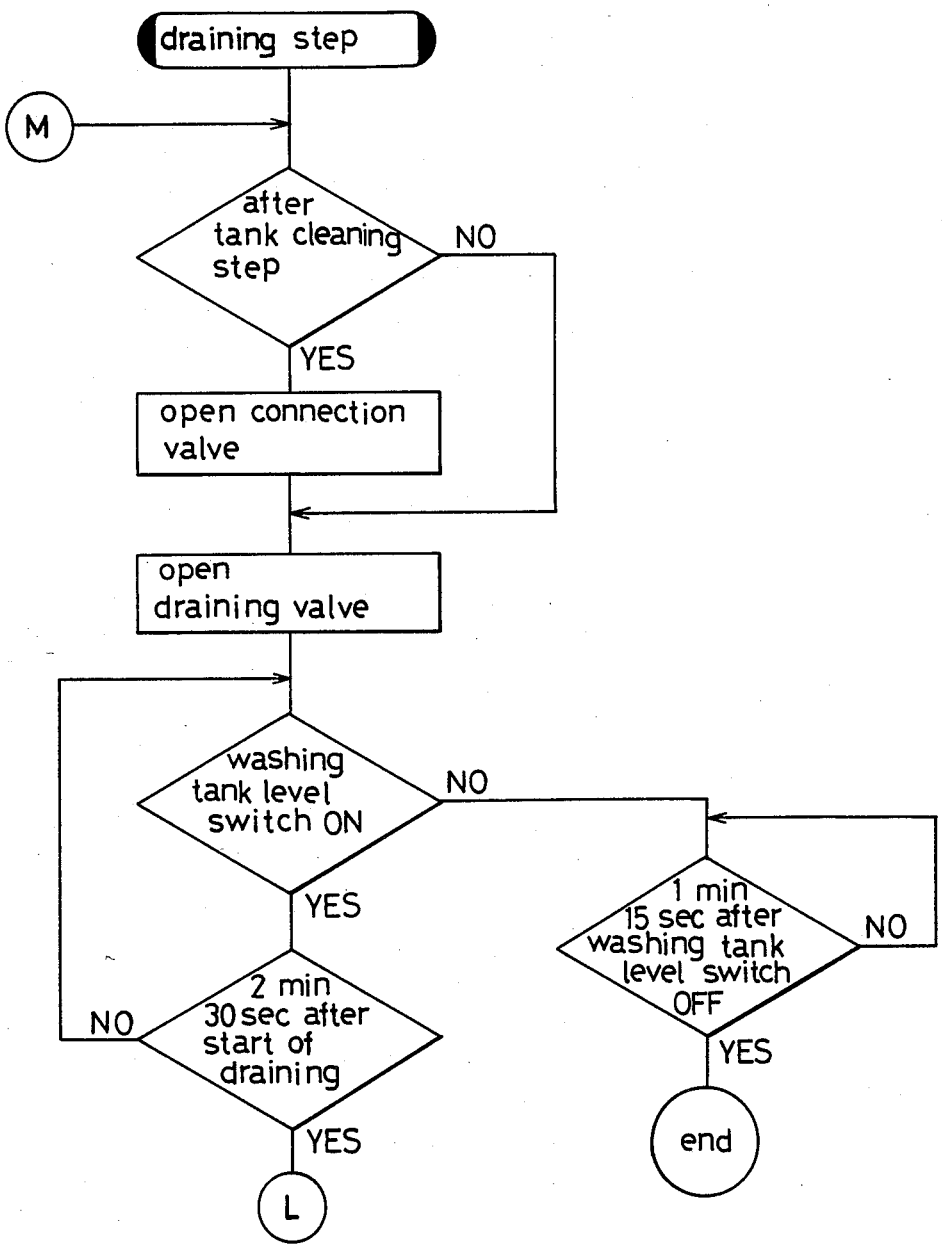
Figure 10B:
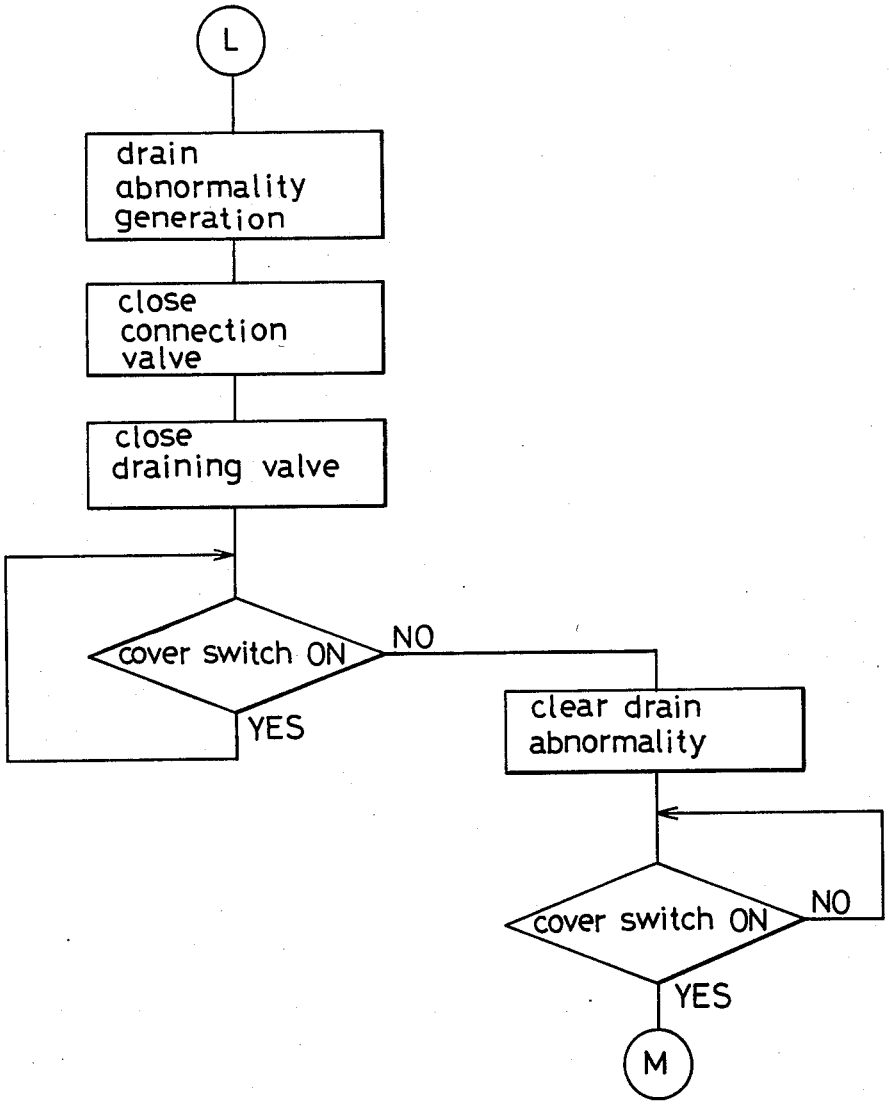
Figure 11:
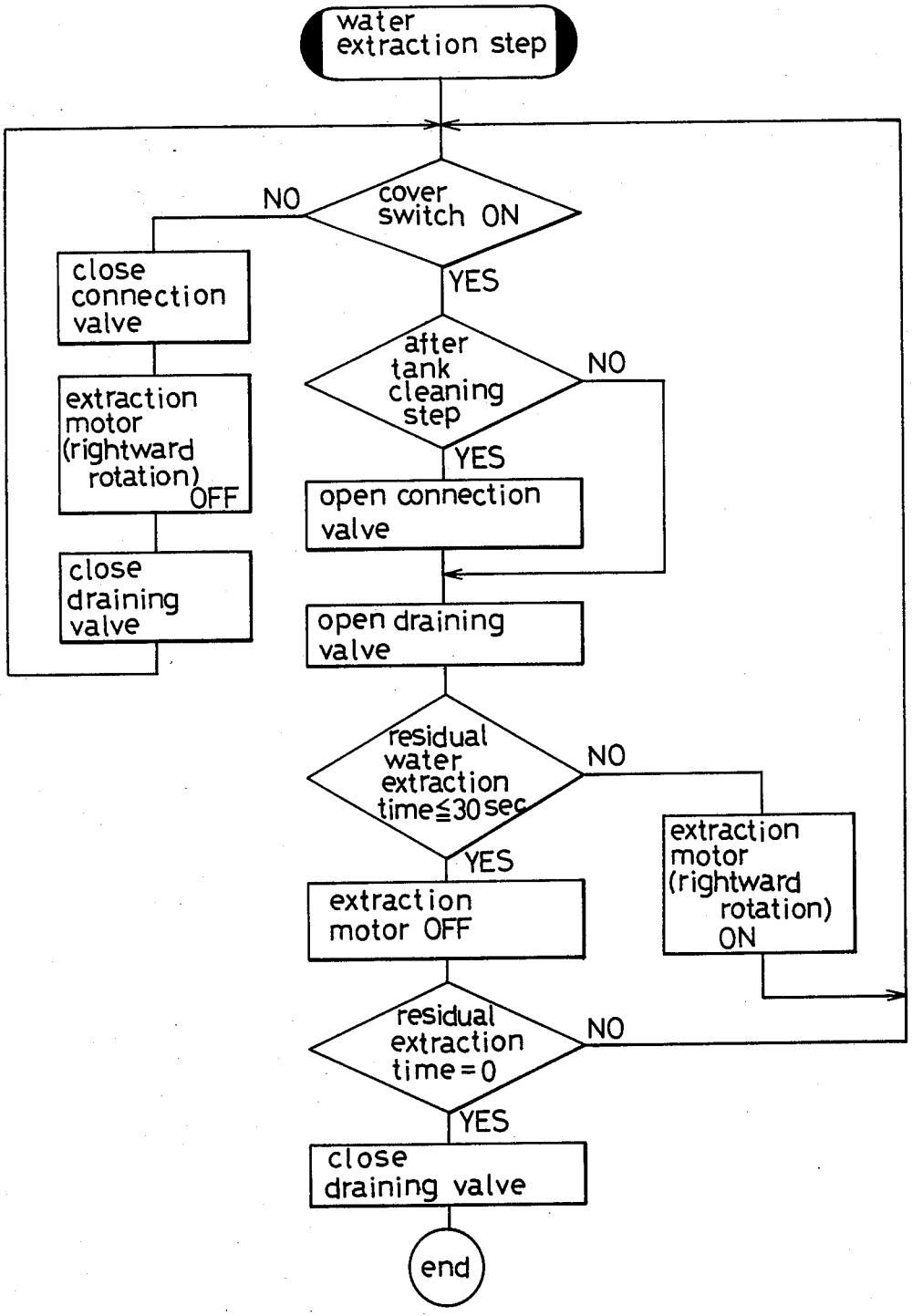

Next, the draining step is explained referring to FIG. 10(*a*)(*b*). In a case where the microcomputer 23 memorizes that the tank cleaning step has already been carried out, the draining valve 10 is opened and the connection valve 17 is also opened to perform draining for the water store tank 15. Water is drained till the elapse of one min and 15 sec after the opening of the water level switch 25. However, if the water level switch 25 is not opened even after the draining operation has been continued for 2 min and 30 sec, the microcomputer 23 judges the abnormality in the draining step to close the connection valve 17 and the draining valve 10 and store the condition in its memory. The abnormality in the draining step is erased from the memory of the microcomputer 23 by opening the top cover 42 and temporarily opening the cover switch 41, and water draining is carried out again by the closure of the cover switch 41. Clearing of the memory in the drain abnormality by the opening of the top cover 42 means the followings. The first action usually taken by a washing machine user who believes that washing has been completed is to open the top cover for taking out the washing products. However, if water is present in the washing tank 3 and the operation is interrupted, he finds that there has been an abnormality. If it is caused, for instance, by forgetting to open the draining hose, the operation can be restarted instantly by opening the draining hose and closing the top cover 42. Also in the water extraction step in FIG. 11, in the case if the microcomputer 23 memorizes that the tank cleaning step has already been practiced, the connection valve 17 is opened during water extraction operation and water remained in the water store tank 15 is drained. Upon water extraction operation, the microcomputer at first judges whether the top cover 42 is closed or not by the ON-OFF state of the cover switch 41. Then, only when the cover is closed (cover switch 41 ON), it operates the draining valve actuation solenoid 12 to open the draining valve 10, release the brake and turn the clutch for the water extraction, as well as energizes the rightward rotation drive circuit 37 to rotate the motor 7 and thus the washing tank 3. When the washing tank 3 is rotated with a high speed, water in washing products is well taken off by the aid of centrifugation. The motor 7 stops its rotation when the remaining operation time for the water extraction is decreased to 30 sec, so that noises may be reduced when the solenoid 12 is deenergized to apply a braking action.

Figure 12A:
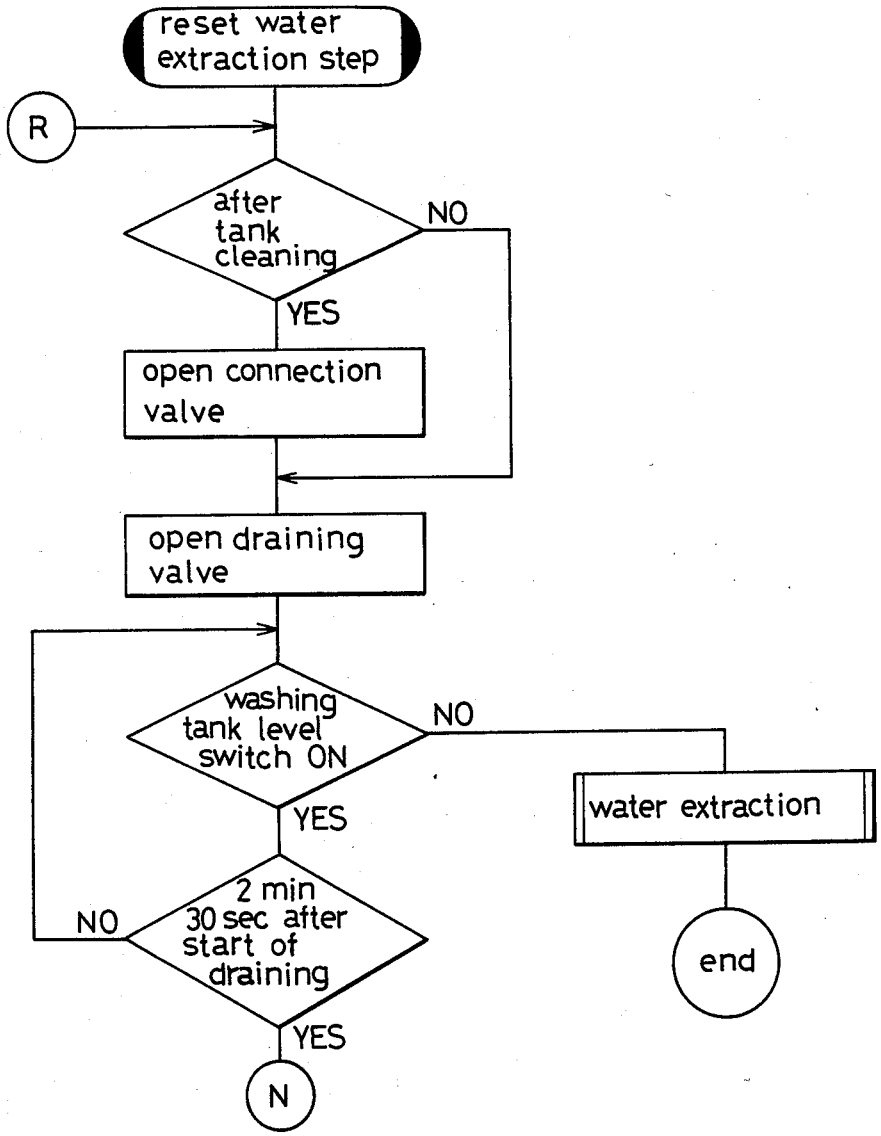
Figure 12B:
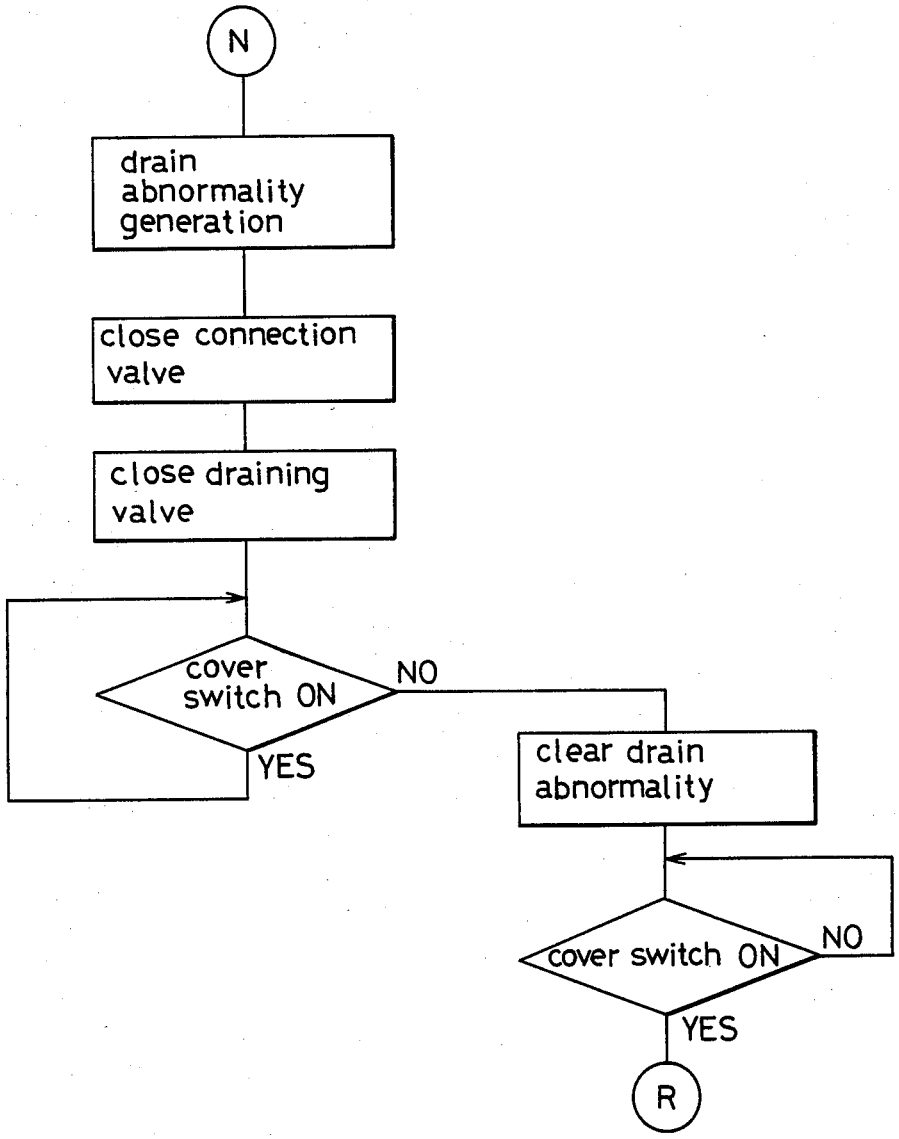

The reset water extraction step shown in FIG. 12(*a*),(*b*) comprises the draining step and the water extraction step as described above in combination, in the which water level switch 25 is opened (reset).

Figure 13A:
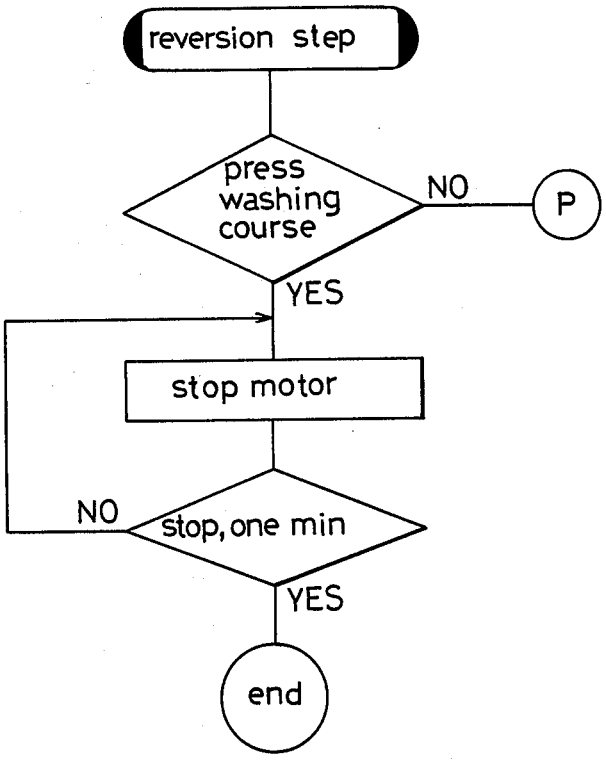
Figure 13B:
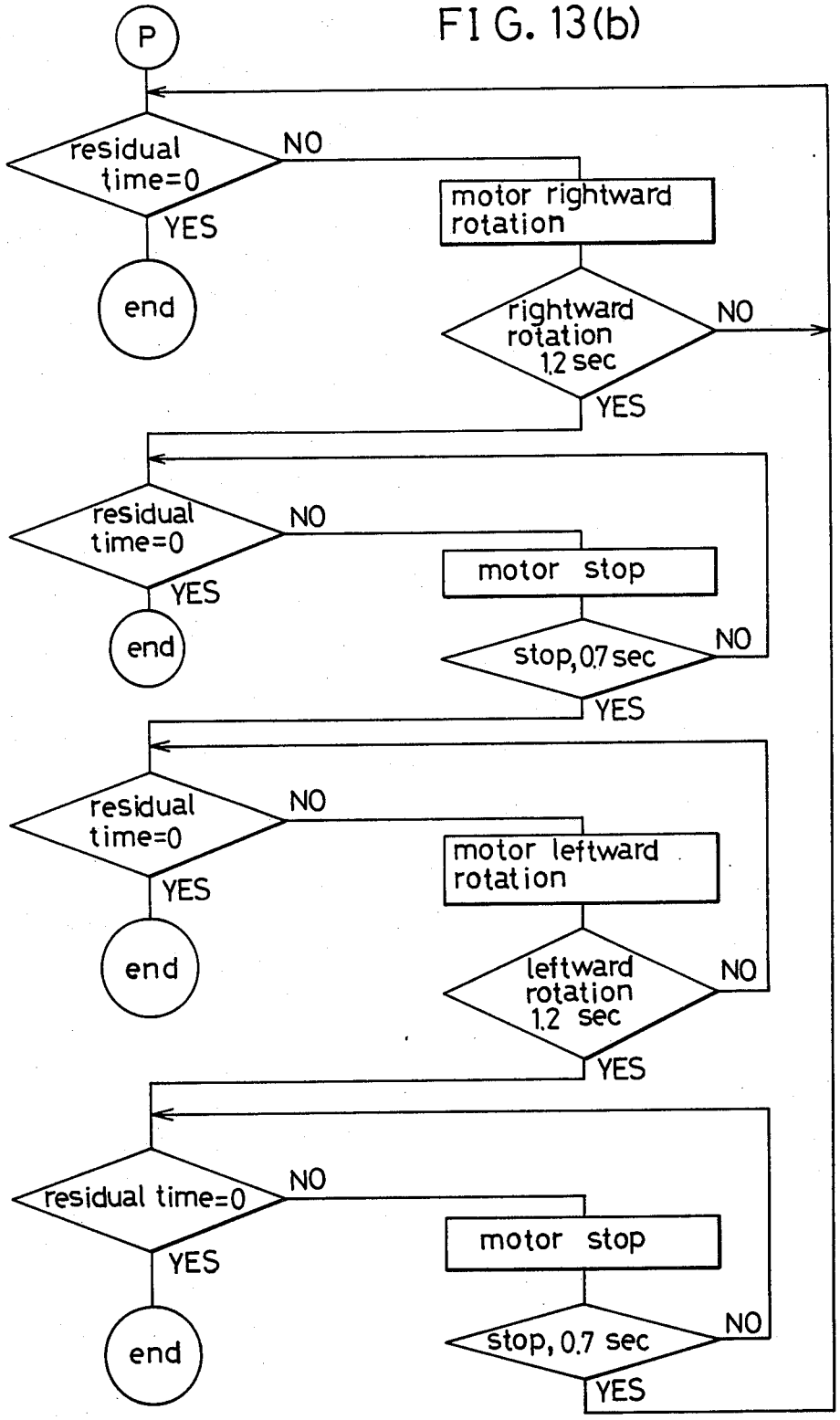

Referring to the reversion step in FIG. 13 (*a*),(*b*) agitator 6 is not rotated but stays for 1 min in the press washing course selected by the course selection and start switch 33. That is, the washing products are soaked as they are. In other courses selected by other course selection and start switches 28–32, the motor 7 is rotated forwardly and backwardly by the electrical energization of the driving circuits 37 and 38 each by 1.2 sec with an intervention of 0.7 sec of stop. While not illustrated in the flow chart, in the case where the rinsing turn-over switch 26 is turned on the side of the overflow rinsing during the rinsing step, the water feed valve 35 is opened simultaneously with the reverse operation of the motor to practice the overflow rinsing.

The entire operation of the washing machine having a water store tank according to this embodiment will now be explained referring to the flow charts shown in FIG. 5(*a*) through FIG. 6(*c*). Upon turning ON the power source switch 22, the microcomputer 23 is started to operate. After reset for the output terminal of the microcomputer, the random access memory (RAM) is cleared to attain the initial state. When input is applied through one of the course selection and start switches 23–33, a course corresponding to the input is set. In a case if none of the course selection and start switches 28–33 is depressed within 3 sec thereafter, the operation for the set course is started and the change of the course is no more possible thereafter since none of the inputs from the start switches 28–33 is allowed. On the contrary, if one of other start switches 28–33 is depressed within 3 sec, a course is set based on the latter start switch. If an identical start switch 28–33 is depressed twice successively within 3 sec, this selects a careful course, in which a longer time is set each for the period of washing step, rinsing step and water extraction step time. Upon depressing any one of the start switches 28–33 while situating the reuse turn-over switch 34 to the (water store tank) draining position, the (water store tank) draining course is set.

The (water store tank) draining course is to be explained at first. In the draining course, if the connection valve 17 and the draining valve 10 are opened, as well as the top cover 42 is opened to open the cover switch 41 and the water level switch 23 is opened (no water in the washing tank 3), the water feed valve 35 is opened for one min after the start of the operation to feed water through the water feed port 36. By connecting an external hose to the water feed port 37, water is introduced through the hose to the water store tank 15, so that contaminations in the water store tank 15 not removed in the tank cleaning step as described above can be cleaned with ease. Water introduced to the water store tank 15 is immediately drained since the connection valve 17 and the draining valve 10 are opened. Of course, the inside of the washing tank 3 can also be cleaned with ease.

The water feed valve 35 is opened only when the water level switch 25 is opened as described above, because if water is fed from the water feed port 36 in a case where there is water in the washing tank 3 and the draining hose is not opened, water may some time over flow.

Furthermore, since the water feed valve 35 is not opened when the top cover 42 is closed to close the cover switch 41, only the draining operation can be carried out for the water store tank 15 or the washing tank 3.

The connection valve 17 and the draining valve 10 are closed 3 min after to ring the buzzer 43 and inform the end of the (water store tank) draining course.

Then, the press washing course which forms one of the features of this invention will be explained. This course is carried out upon washing sensitive fabrics such as sweaters or blankets. Washing for such fabrics have to be carried out so that no creasing, pilling shrinkage or elongation may be resulted, that is, no degradation is caused in so-called feeling in addition to consideration for the improvement in the cleaning power. This course of washing is carried out by separation of to contaminants for removal by soaking the washing products sufficiently in a cleaning water and then carrying out water extraction after transferring the water in the washing tank at least for once into the water store tank.

Fundamentally, the press washing course is carried out by combining a first step of charging washing products into laundry water in the washing tank then soaking the products over a predetermined period of time in the laundry water while rotating optionally the agitator by the actuation of rotational means therefor during the period, a second step of transferring water in the washing tank from the washing tank to the water store tank by the actuation of the forward water transfer means and storing the water in the latter, a third step of transferring the water stored in the water store tank from the water store tank to the washing tank by the actuation of the backward water transfer means, a fourth step for extracting water in the washing products by the actuation of the rotational means for the washing tank between the second step and the third step during by at least one cycle while the first through the third steps are repeated in this order more than one cycle, and a fifth step of draining laundry water by the actuation of the draining means.

Figure 6A:
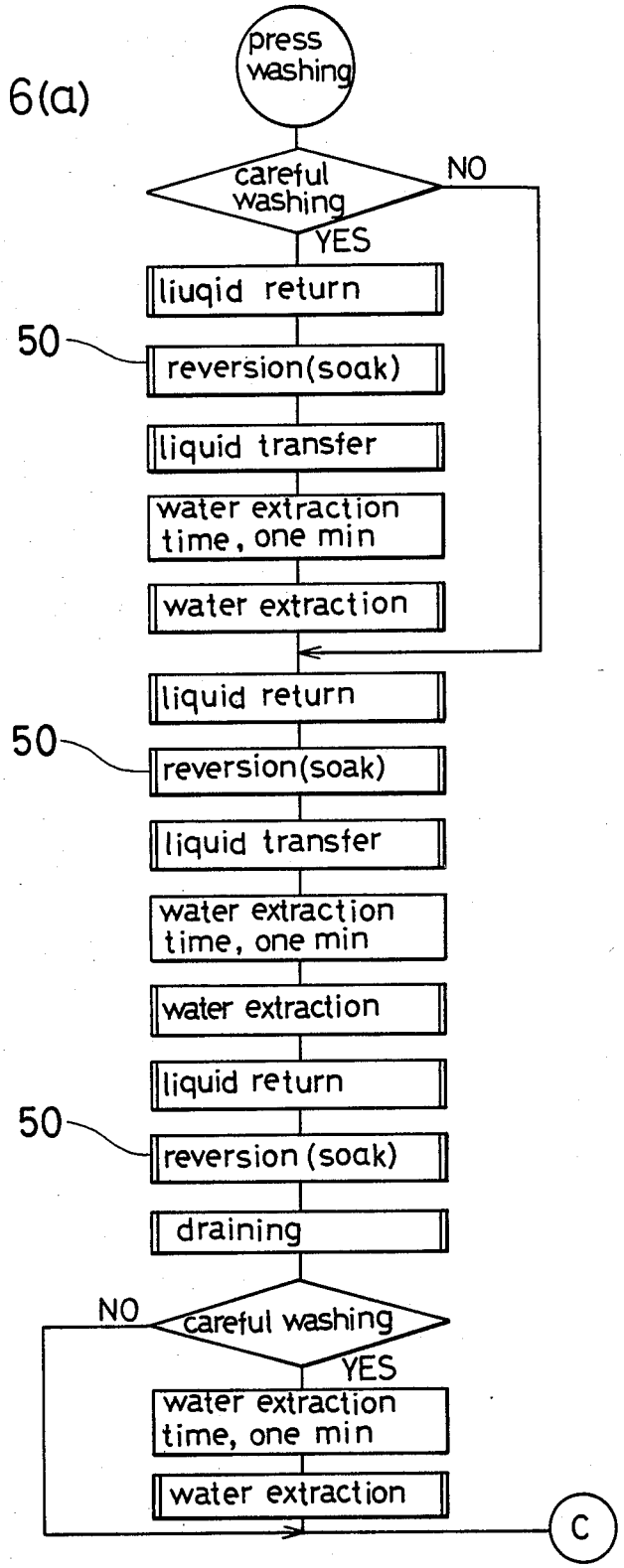
Figure 6B:
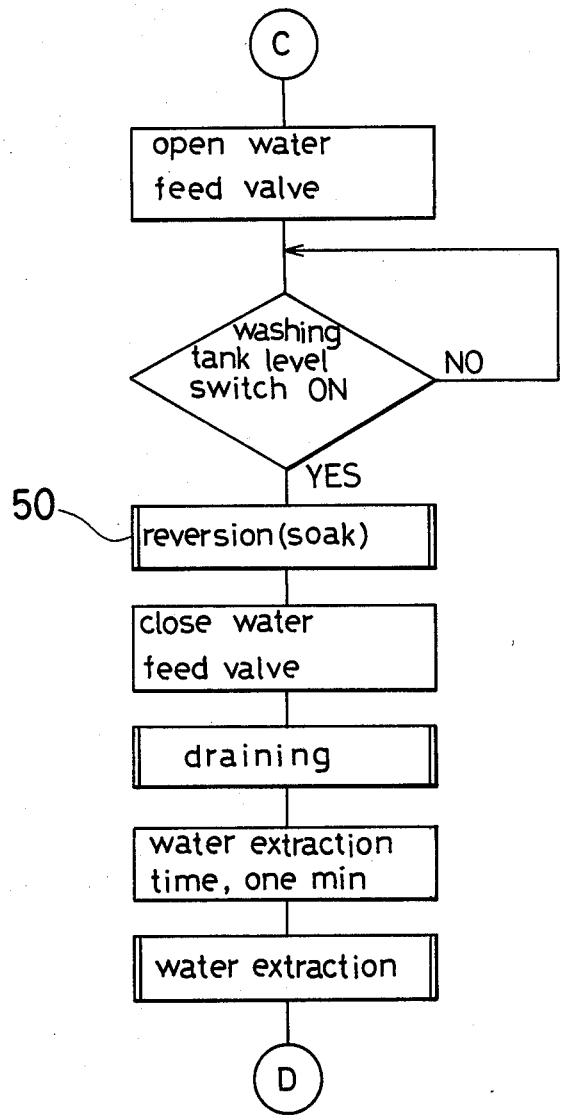
Figure 6C:
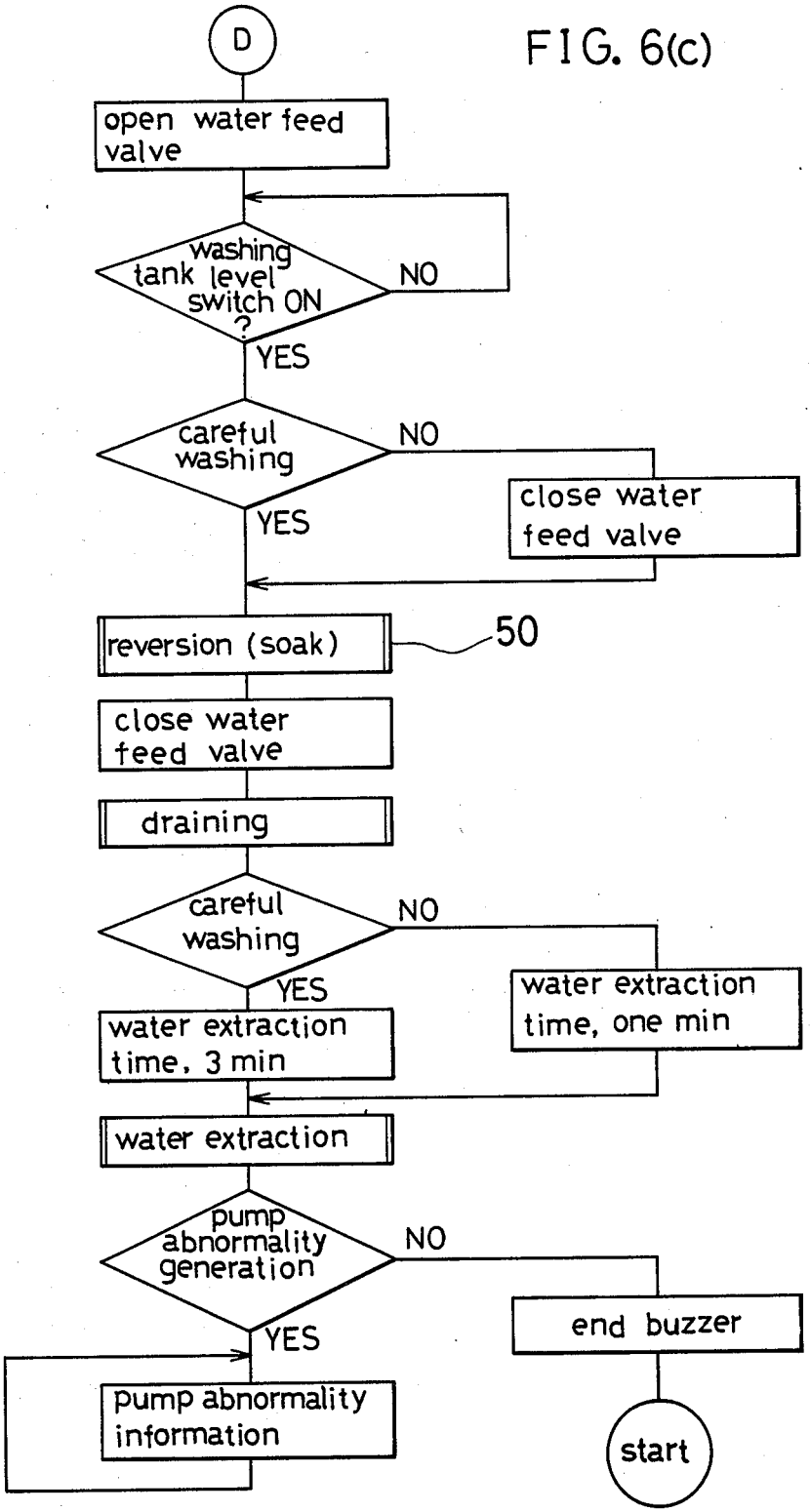

Specifically, as shown in the flow chart of FIG. 6(*a*),(*b*),(*c*), in the washing step of the press washing course, the foregoing cycle of (liquid return (water feeding)–reversion (one min)–liquid transfer–water extraction one min) as described above is carried out twice in the careful course and once in the standard course. Then, liquid return and reversion (one min) are carried out and the step is advanced to the draining step. As apparent from the flow chart shown in FIG. 13(*a*),(*b*), the reversion operation in this case means to stop the agitator 6 for one min while not rotated, during which the washing products are soaked as they are in laundry water. The comment "soak" attached below the description "reversion" in FIG. 6(*a*),(*b*),(*c*) has such meaning. In this way, by carrying out water extraction after soaking the washing products for one min in laundry water thus allowing water to sufficiently intrude therein, contaminations contained in the fabrics are separated for removal and the fabrics are cleaned. The term "press washing" is adopted because the washing products are pressed to the washing tank during this water extraction. Since the agitator 6 does not rotate in such a cleaning mode, there is no friction between the agitator and the washing products or between the washing products with each other, whereby no degradation in the feeling is resulted at all.

After the draining step has been complete, water extraction step is carried out for one min in the careful course but the water extraction may be saved in the standard course.

In the first rinsing step, overflow rinsing for the foregoing reversion (soak) is carried out for one min irrespective of the rinsing turn-over switch 26, draining and water extraction are carried out for one min to advance to the second rinsing step. The first rinsing is carried out as overflow rinsing, because since the agitator 6 does not rotate in the press washing course, large suspended matters can not be removed with ease although the fine suspended matters can be removed through water extraction and, accordingly, such large suspended matters are overflown to remove by the overflow rinsing through the over flown port 13 and thereby improve the rinsing efficiency.

In the second rinsing, overflow rinsing is carried out for the careful course and deep rinsing is carried out for the standard course each for one min respectively. Thereafter, water is drained and water extraction is carried out for 3 min in the careful course and for one min in the standard course. After the completion of the water extraction, the microcomputer rings the buzzer 43 if it has a memory for the pump abnormality to inform the same and, while on the other hand, if there is no abnormality, to inform the completion and returns to the initial state. In the case of the pump abnormality, the buzzer rings intermittently for 10 sec in a shorter period as compared with the completion of the course and, 10 sec after, a display lamp not shown is kept to flicker.

The reversion (soak) shown by the refrence numeral 50 in the flow chart of FIG. 6(*a*),(*b*),(*c*) may be replaced with the cycle of (reversion (soak)–liquid transfer–liquid return–reversion (soak)). By carrying out liquid transfer and return before the water extraction, airs contained in the washing products are removed to enable the sooner impregnation of the cleaning water, as well as the concentration of the cleaning water can be made uniform to improve the cleaning performance. While the cleaning water situated at a severley contaminated area has a reduced apparent density and may undergo recontamination, the concentration is unified through the liquid transfer and liquid return to prevent such recontamination and improve the cleaning performance.

Although the agitator 6 is not rotated at all in the foregoing embodiment, it may be rotated alternatively rightwardly and leftwardly for a short period of time. Specifically, the operation of "reversion" shown in FIG. 13(*a*),(*b*) may be altered as shown in FIG. 14(*a*),(*b*). In the case of the press washing course in FIG. 14(*a*), the cycle of rightwardly rotating the motor 7 and thus the agitator 6 by supplying a current to the driving circuit 37 for 1.2 sec, stopping for 0.7 sec, thereafter, leftwardly rotating the motor 7 by supplying a current to the driving circuit 38 for 1.2 sec, followed by 6.9 sec of stop is repeated for 6 times. Since the steps in FIG. 14(*b*), except for the press washing course are the same as in FIG. 13(*b*) their explanations are omitted.

Figure 14A:
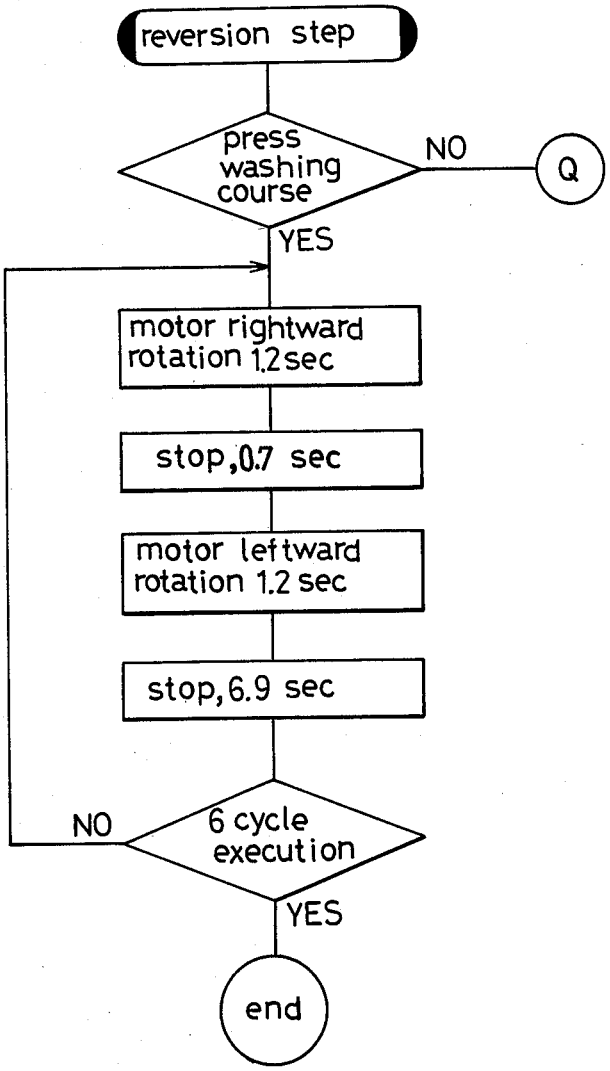
Figure 14:
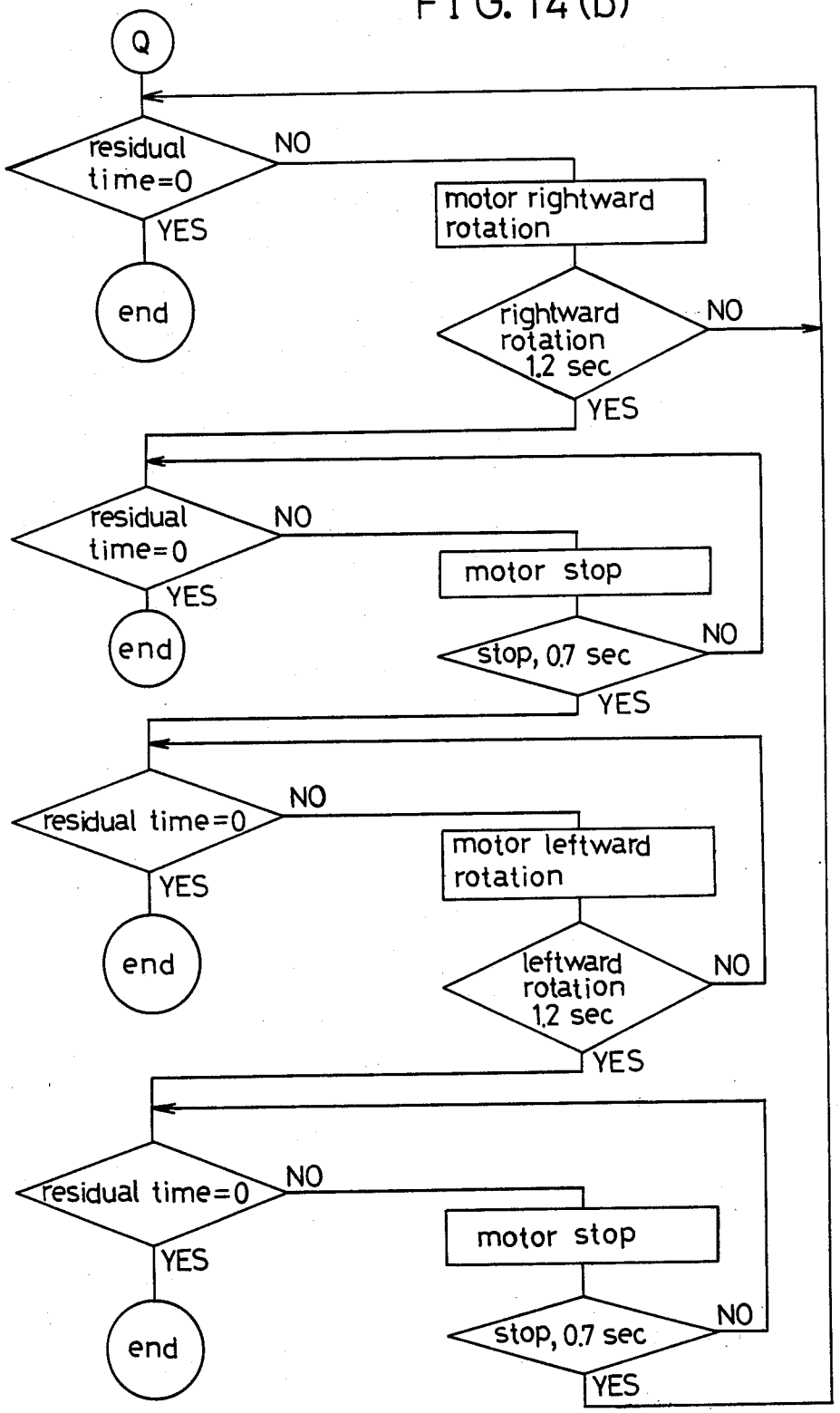

Then, "the reversion" shown in FIG. 14(*a*) may be practiced at the step shown by reference numeral 50 in the flow chart of FIG. 6(*a*),(*b*),(*c*). By rotating the agitator alternately rightwardly and leftwardly for a short period of time, laundry water can sufficiently be impregnated into the washing products with ease, mechanical shocks are applied moderately to the washing products in such a degree as not to degrade the feelings to improve the washing performance. It is of course possible to replace the step at reference numeral 50 in FIG. 6(*a*),(*b*),(*c*) with the cycle of (reversion–liquid transfer–liquid return–reversion) by using "reversion step" shown in FIG. 14(*a*).

In the usual washing course, each of the courses is operated as shown in the step chart in FIG. 4 by the combination of the course selection and start switches 28–32 and the reuse turn-over switch 34. Detailed explanations therefore will, however, be saved here since they have no direct concerns with the concept of this invention.

What is claim is:

1. A washing machine having a water store tank comprising:

a machine main body, an outer tank disposed to said main body, a washing tank rotatably supported within said outer tank and also serving as a water extraction tank, water feed means to said washing tank, a top cover for said washing tank, an agitator disposed to the inside of said washing tank, rotational means for rotating said washing tank, a water store tank disposed to the washing machine main body, forward and backward water transfer means for transferring laundry water between said water store tank and said washing tank to each other, draining means for draining laundry water in the washing tank; and control means for automatically actuating each of said means, wherein said control means gives an instruction to each of said means so as to carry out, a first step of charging washing products into laundry water in the washing tank and keeping them for a predetermined period of time in laundry water and optionally rotating the agitator by the actuation of the rotational means for said agitator during said predetermined period, a second step of transferring laundry water in the washing tank by means of the actuation of the forward water transfer means from the washing tank to the water store tank to store water in the latter, a third step of transferring laundry water stored in the water store tank by means of the actuation of the backward water transfer means from the water store tank to the washing tank, a fourth step of extracting water from the washing products by the actuation of rotational means for the washing tank between the second step and the third step in at least one cycle during repitition of the first through third steps in this order for more than one cycle, and a fifth step of draining laundry water by the actuation of the draining means, wherein at least the washing tank has a detection means that judges the presence or absence of water and issues an indication signal therefor, wherein the water drain means is stopped if a signal from the detection means of the washing tank does not change within a predetermined of period in the fifth step, wherein the water draining means is released from its stopping state by the opening and closing operation of the top cover for the washing machine.

* * * * *